US005103707A

United States Patent [19]

Hogue

[11] Patent Number: 5,103,707

[45] Date of Patent: Apr. 14, 1992

[54] MANUFACTURING AND TUNING A MUSICAL INSTRUMENT

[76] Inventor: John H. Hogue, 436 S. Saginaw St., Ste. 108, Flint, Mich. 48502

[21] Appl. No.: 602,181

[22] Filed: Oct. 23, 1990

Related U.S. Application Data

[63] Continuation-in-part of Ser. No. 553,103, Jul. 13, 1990, Pat. No. 5,025,694, which is a continuation-in-part of Ser. No. 264,352, Oct. 31, 1988, Pat. No. 4,941,383.

[51] Int. Cl.[5] ..... G10C 3/06

[52] U.S. Cl. ..... 84/192; 84/275; 84/291; 84/411 R

[58] Field of Search ..... 84/187, 192, 193, 194, 84/195, 274, 275, 276, 277, 282, 291, 292, 411 R, 417, 177

[56] References Cited

U.S. PATENT DOCUMENTS

| | | | |
|---|---|---|---|
| 485,651 | 11/1892 | Perry | 84/282 |
| 3,122,960 | 3/1964 | Stühlen | 84/282 |
| 3,884,109 | 5/1975 | Johnson | 84/275 |
| 4,373,980 | 2/1983 | Skalmierski et al. | 84/275 X |
| 4,407,181 | 10/1983 | Thomas | 84/275 |
| 4,941,383 | 7/1990 | Hogue | 84/275 |
| 5,025,694 | 6/1991 | Hogue | 84/282 |

FOREIGN PATENT DOCUMENTS

| | | | |
|---|---|---|---|
| 58478 | 4/1913 | Austria | 84/282 |
| 27605 | 12/1908 | United Kingdom | 84/282 |
| 433422 | 8/1935 | United Kingdom | 84/282 |

*Primary Examiner*—L. T. Hix
*Assistant Examiner*—Howard B. Blankenship
*Attorney, Agent, or Firm*—Charles W. Chandler

[57] ABSTRACT

A method for manufacturing and tuning a musical instrument having a sound board that is excited by either a string, as in a guitar, or a percussion instrument, such as a drum. The sound board is tuned by holding it in position such that it can vibrate, tapping it to determine the actual audible sound at the tapped location to a desired sound, and then either adding or reducing the material at the tapped location to achieve the desired sound.

20 Claims, 2 Drawing Sheets

MANUFACTURING AND TUNING A MUSICAL INSTRUMENT

CROSS REFERENCE TO RELATED APPLICATIONS

This application is a continuation-in-part of patent application Ser. No. 553,103, filed July 13, 1990 for TUNING THE WOOD OF A MUSICAL, INSTRUMENT BOW, since issued as U.S. Pat. No. 5,025,694 on June 25, 1991 which in turn was a continuation-in-part of the application Ser. No. 264,352 filed Oct. 31, 1988, which issued as U.S. Pat. No. 4,941,383 for a "Method for Tuning Violins", July 17, 1990.

BACKGROUND OF THE INVENTION

This invention is related to a method for manufacturing and tuning a musical instrument having a sounding board which may support either sound ribs, or sound bars. The sound bars or ribs, as the case may be, are tuned by a tapping procedure that creates a sound at a particular location. The actual sound is compared to a desired sound, and then changed by either adding or removing material from the tapped location in order that the actual tapped sound is consistent with the desired sound.

Many musical instruments employ a sound board or sound bar which vibrates when excited, for example in the case of a piano, when a string is struck by a hammer. In the case of a drum, a sound member is excited by the contact of the drum stick with the drum skin.

The sound board of a piano may consist of a carefully prepared wooden panel about ⅜'s of an inch thick. The vibrations of the strings are transmitted to the sound board. The sound board determines the character of the sound of the piano.

Similarly, for a stringed instrument such as a guitar or violin, the strings are excited by the vibration of a steel or a gut string pulled tight, and either struck, plucked or rubbed by stretched horse hair or the like. The vibration frequency or pitch depends on the length of the string, its weight and tautness. The loudness of the sound depends on the string vibration.

However, the string alone, held at its ends and caused to vibrate, will make only a barely audible sound since it cuts through the air causing only a mild local disturbance. To get large quantities of air into motion, you add a sounding board or box. The string transmits its vibrations to the board or box through a bridge. Typically, the strings are held by rotatable pegs which are used to tighten and thereby to tune the strings.

In my forementioned patent, I disclosed how to improve a violin by tuning the front ribs and plates by a tapping procedure. In my forementioned patent application, I disclosed a further improvement in which a violin bow is tuned by a similar tapping procedure.

SUMMARY OF THE INVENTION

The broad purpose of the present invention is to provide a tapping procedure for tuning other musical instruments having a sound board that vibrates to amplify the tone of the instrument.

Another object is to provide such a tuning procedure that can be carried out on a production basis by tuning a master sound board or sound bar, and then by weighing it, make other substantially tuned sound bars for other instruments.

Still another object is to provide a tuning procedure in which a musical instrument sound component is tapped to compare the actual sound at a localized area on a sound bar to a desired sound. The sound is changed by modifying the quantity of the sound bar material at the tapped location. The modification can be achieved either by removing the material, as in the case of a wooden sound bar, or by adding material, such as on a metal instrument. The process is useful on any metallic or non metallic instrument.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
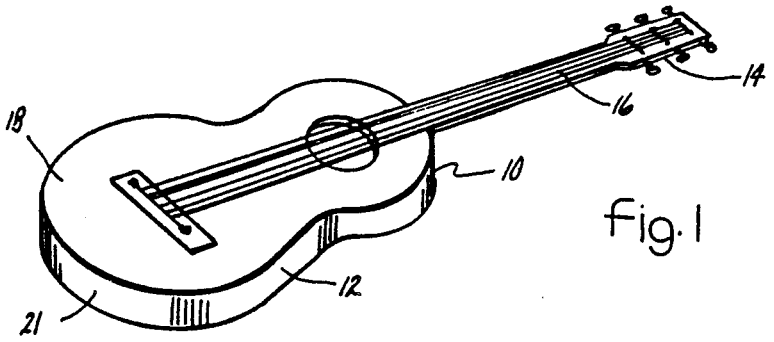
FIG. 1 is a perspective view of a guitar having front and back plates and sides tuned in accordance with the invention.

Referring to the drawings, FIG. 1 illustrates a guitar 10 having a sound box 12, a neck 14 and string means 16. The sound box has an upper, front plate 18, a back plate and a sidewall 21. The front and back plates and the sidewall are all tuned by my inventive procedure.

Figure 2:
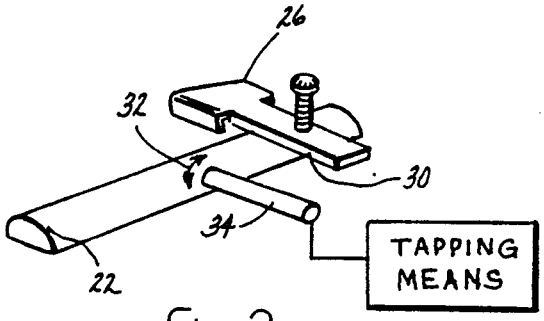
FIG. 2 is a view showing a sound bar of the guitar of FIG. 1 being tuned.
Figure 3:
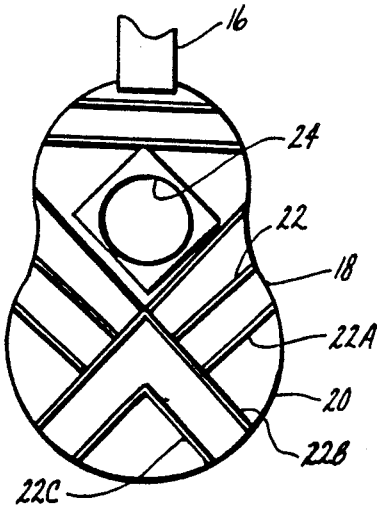
FIG. 3 is a view of the top or front plate of the guitar of FIG. 1, tuned in accordance with the invention.

Referring to FIG. 3, front plate 18 comprises a wooden sound board 20, having a plurality of what are known as stress or sound bars 22 arranged in a desirable relationship, and a 4 inch sound hole 24. A typical sound bar 22 is illustrated in FIG. 2.

Plate 18 is a sounding member and can be made either by tuning the individual bars and then attaching them to plate 18, or attaching the sound bars to the plate and then individually tuning the bars on the plate or tuning the combination of the plate and bars.

For illustrative purposes, referring to FIG. 2, typical sound bar 22 is tuned by clamping it in a clamping means 26 at a first location 30 and then tapping the sound bar at a second location 32 spaced from the clamping location. The tapping can be accomplished by a tapping instrument 34 such as a pencil, or the fore end of the user's finger. Normally, the user taps the sound bar by manipulating the instrument 34 with his hand and then listen to the tone produced by the tapping. If the tone varies from the desired tone, the user then changes the amount of the material at the tapped location. If the sound bar is wooden or metallic, he can reduce the thickness of the sound bar by sanding the bar at the tapping location to reduce its sound to a lower note. If the rib or sound bar 22 is either metal or non metallic, he has the option of either adding sound bar material to raise the note, or reducing the material, such as by filing, to lower the note.

When the desired sound is produced at the tapped location 32, by an appropriate adjustment of material at the tapped location, the user repeats the procedure by mounting the clamping means at location 32 and tapping the sound bar at a further location in advance of the previous tapping location. The sound bar material is adjusted and the process repeated until the entire sound bar has been tuned such that substantially the identical actual note is audibly produced regardless of the position along the sound bar at which the tapping is conducted. This process is similar to that disclosed in my forementioned patent application for tuning the bow of a violin.

If the sound bar is metal, the sound bar material can be either added or reduced to change the actual audible sound.

Assuming sound bar 22 is of wood, it is attached, as by glue, to plate 18. The process is repeated for the remaining sound bars 22A, 22B, 22C, and so forth. When all the sound bars have been attached to the sound board, the assembly then has a desired sound.

Sidewall 12 is tuned in a similar manner as disclosed with reference to the violin of my forementioned patent.

Figure 4:
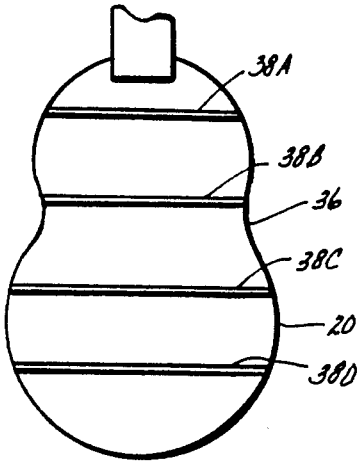
FIG. 4 is a view of the bottom plate having the ribs tuned in accordance with the invention.
Figure 4A:
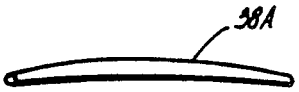
FIG. 4A illustrates a tuned, bowed sound bar.

Referring to FIG. 4, bottom plate 20 comprises a board 36 having sound bars 38A, 38B, 38C and 38D tuned in a similar manner. That is, each of the sound bars is individually tuned and then attached to sound board 36 by adhesive means. A typical tuned sound bar is illustrated in FIG. 4A.

For illustrative purposes, the bottom plate and the sidewall are preferably tuned at least one note different from front plate 18. However, they can be tuned two notes higher or lower depending upon the desires of the user.

For production purposes, if the instrument is of metal, such as steel, or non metallic materials, such as wood, alloy, plastic, Fiberglas, or any suitable material, sound bar 22 can be weighed after it is tuned, to form a master sound bar. Its center of gravity is also marked. Another sound bar, having a similar cross section, can then be produced in a manufacturing process by removing material along the length of the sound bar until it has a similar weight and center of gravity to the master sound bar. A mass produced sound bar can be mounted on a sound plate to provide a plate having sound characteristics closely approaching that of a plate having the master sound bar.

A similar process can be used for making a bow for a violin. First a master bow can be made from any suitable material. The master is tuned by tapping. The instrument is then weighed and balanced.

A master bow can also be made from any material that will melt. The production bow can then be made from the master bow by pouring the melted material in a mold. The master cast bow is weighed and balanced according to the master bow. An advantage of a cast bow is that the material is more homogeneous than wood.

Figure 5:
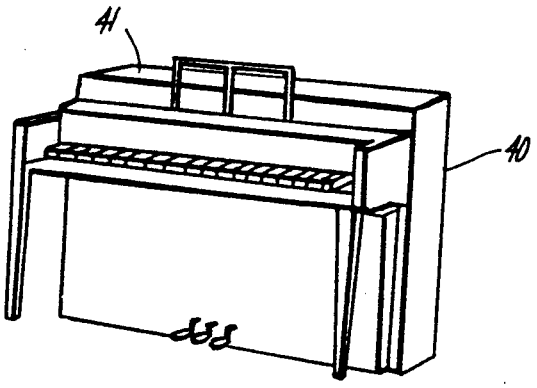
FIG. 5 is a view of a piano having a sound board tuned in accordance with the invention.
Figure 7:
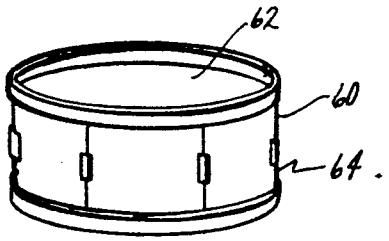
FIG. 7 is a drum tuned in accordance with the invention.
Figure 6:
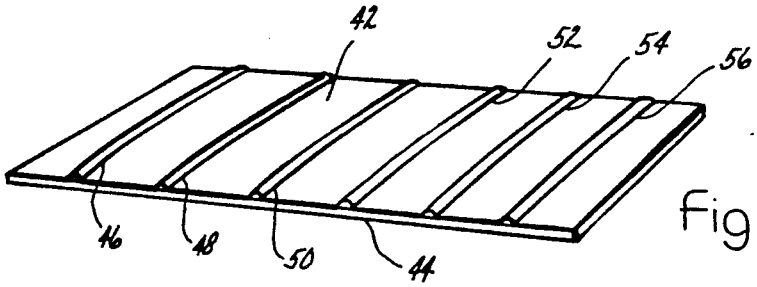
FIG. 6 is an enlarged view of the sound board of the piano of FIG. 5.
Figure 8:
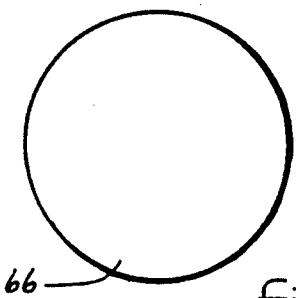
FIG. 8 is a view of one side of the bottom wall of the drum.
Figure 10:
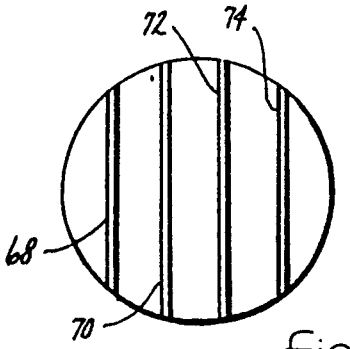
FIG. 10 is a view of the inside wall of the drum.

Referring to FIGS. 5 and 6, a similar process can be employed on piano 40. As is well known, pianos produce sound by a hammer striking a string. The string vibration is amplified by a sounding member 42, such as is illustrated in FIG. 6. The sounding board of conventional pianos is relatively thick. I propose a piano sounding board that is tuned in a manner similar to that of a guitar made according to my invention. In this case, the sounding member 42 comprises a sound board of a carefully prepared wooden panel 44 about three-eighths of an inch thick. For illustrative purposes, the piano may have a width of about thirty-seven and five-eighths inches, and a length of about fifty-six and three-fourths inches. The sounding member has sound bars 46, 48, 50, 52, 54, and 56. The actual number of sound bars may be larger as you go to higher tones. The sound bars are tuned in the same manner as described with reference to the embodiment of FIG. 2, however, each sound bar may be tuned to a different note. For example, bar 46 may be tuned for the note "C" and each sound bar, as you move toward the right, as viewed in FIG. 6, is tuned for a higher note.

It is to be understood that the sound board may take a variety of shapes according to whether the piano is an upright, a grand piano or the like.

The piano has a pair of lids, only one, 41, shown. The lid is hinged so it can be opened to function like a speaker for directing the piano's sound toward the audience. Lid 41 and the other lids are also tuned in accordance with the preferred method. However, each lid is tuned to a different note to avoid a sound clash. A tuned lid functions as part of a sound chamber.

FIGS. 7–10 illustrate a drum 60 having a skin 62 mounted on a cylindrical metal head 64. A bottom wall 66 is mounted at the lower end of the cylindrical wall. Wall 66 preferably in the form of a flat wooden member, has for illustrative purposes, four spaced sound bars 68, 70, 72 and 74 mounted on the inside of the drum.

Figure 9:
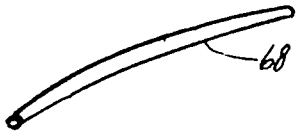
FIG. 9 is a view of a sound bar tuned for attachment on the bottom wall of the drum.

FIG. 9 illustrates a typical sound bar 68. Each sound bar is tuned in the manner described with reference to the embodiment of FIG. 2, and then attached to bottom wall 66 to form a sounding chamber member that is set into vibration when the drum stick, not shown, strikes skin 62.

Thus, it is to be understood that I have described an improved method for manufacturing a tuned musical instrument in which the sound-producing members set into vibration when the instrument is played, are tuned by progressively tapping locations spread over the entire area of the sounding board. The tuning step includes either adding or reducing material at the tapping location. The sound bars may be individually tuned and then mounted on the board, or mounted on the board and then tuned or the combination of board and bars is tuned. The final product is tuned throughout substantially the entire vibrating area.

All metal instruments may be made with a softer tone by soft paint or material coated on the inside of the sound chamber. For wood, use course sandpaper for a soft sound or a fine sandpaper for a hard sound.

Having described my invention, I claim:

1. A method of tuning a sounding member of a musical instrument, wherein said sounding member comprises a sound board and a plural number of sound bars; said method comprising the steps of:

a. tapping one of the sound bars at a first selected location therealong, to produce an audible sound;

b. comparing the produced sound with a desired reference sound;

c. changing the amount of sound bar material at the selected location, to thereby produce an audible sound that substantially duplicates the reference sound; and, d. repeating steps a, b and c at other selected locations along said one sound bar.

2. The method of claim 1, wherein steps a, b, c and d are performed on each of the sound bars associated with said sound board.

3. The method of claim 1, wherein steps a, b, c and d are performed while said one sound bar is detached from said sound board.

4. The method of claim 1, wherein steps a, b, c and d are performed after said one sound bar has been attached to said sound board.

5. The method of claim 1, wherein steps a, b, c and d are performed on each of the sound bars associated with said sound board; step b being accomplished with different reference sounds for different ones of the sound bars.

6. The method of claim 1, wherein step a is performed with said one sound bar clamped to a fixed support structure at a point spaced from said selected tapping location.

7. The method of claim 1, wherein said musical instrument is a piano.

8. The method of claim 1, wherein said musical instrument is a guitar.

9. The method of claim 1, wherein said musical instrument is a drum.

10. The method of claim 1, wherein the sound board and the sound bars are metallic.

11. The method of claim 1, wherein step c is accomplished by sanding the surface of the sound bar to remove material therefrom.

12. The method of claim 1, wherein said musical instrument is a guitar, the first mentioned sound board being tuned to a first reference sound, and the sounding member comprises a second sound board, and including the step of tuning the second sound board to a second reference sound.

13. The method of claim 12, wherein the guitar has a side wall between said first and second sound boards, and including the step of tuning the side wall to the same reference sound as one of said sound boards.

14. The method of claim 1, wherein said musical instrument is a piano having a hinged lid, and the sound board comprises the hinged lid.

15. A method of tuning a sound bar adapted for use in a musical instrument; said method comprising the steps of:

a. clamping the sound bar to a fixed support at a specific point along the length of the bar;

b. tapping the sound bar at a selected location spaced from the clamping point, to produce an audible sound;

c. comparing the produced sound with a desired reference sound;

d. changing the amount of sound bar material at the tapping location, to thereby produce an audible sound that substantially duplicates the reference sound; and, e. repeating steps a, b, c and d with the sound bar clamped at different selected points therealong.

16. The method of claim 15, wherein step c is accomplished by sanding the surface of the sound bar to remove material therefrom.

17. The method of claim 15, wherein each sequence of steps a, b, c and d constitutes one tuning operation; said tuning operations being carried out so that the tapping location in one tuning operation is used for the clamping point in the next tuning operation.

18. The method of claim 15, in which the sound bar is of metal and including the step of increasing the sound bar material at a tapping location by adding metal.

19. The method of claim 15, in which the musical instrument is a drum having a skin which is struck to produce an audible sound, and the sound bar is a metal head that supports the skin.

20. A method of making a tuned sound bar for use in a musical instrument; said method comprising the steps of:

a. clamping a reference sound bar to a fixed support at a specific point along the length of the reference sound bar;

b. tapping the reference sound bar at a selected location spaced from the clamping point, to produce an audible sound;

c. comparing the produced sound with a desired reference sound;

d. changing the amount of reference sound bar material at the tapping location to thereby produce an audible sound that substantially duplicates the reference sound;

e. repeating steps a, b, c and d with the reference sound bar clamped at different selected points therealong;

f. weighing the tuned reference sound bar; and g. reproducing the tuned reference sound bar for use in other similar musical instruments.

* * * * *